United States Patent [19]

Mizuno

[11] 4,074,730

[45] Feb. 21, 1978

[54] WEFT-YARN DRAWING-OFF AND LENGTH-MEASURING APPARATUS OF WEAVING LOOM HAVING WEFT SELECTOR MEANS

[75] Inventor: Yukio Mizuno, Kodaira, Japan

[73] Assignee: Nissan Motor Company, Limited, Japan

[21] Appl. No.: 722,082

[22] Filed: Sept. 10, 1976

[30] Foreign Application Priority Data

Sept. 22, 1975 Japan ..... 50-128926
Oct. 5, 1975 Japan ..... 50-120036

[51] Int. Cl.[2] ..... D03D 47/36
[52] U.S. Cl. ..... 139/452
[58] Field of Search ..... 139/429, 450, 452, 453; 66/132, 133; 226/184, 186, 187

[56] References Cited

U.S. PATENT DOCUMENTS 3,799,212 3/1974 Stanislav et al. ..... 139/452
3,820,574 6/1974 Mizuno ..... 139/452
4,000,762 1/1977 Mizuno ..... 139/452

*Primary Examiner*—H. S. Jaudon
*Attorney, Agent, or Firm*—Robert E. Burns; Emmanuel J. Lobato; Bruce L. Adams

[57] ABSTRACT

In a weaving loom of the type having program controlled weft selector means, a weft-yarn drawing-off and length-measuring apparatus comprising a detachable length-measuring roller. A pressing roller is in rolling contact with the length-measuring roller and movable relative to the length-measuring roller such as when the length-measuring roller is to be replaced with another roller having a different diameter. A roller guide mechanism including a parallelogrammic four-bar linkage contains the pressing roller to move in an arc. A weft guide mechanism is provided and is operative to move a weft yarn into and out of a position passable between the rollers. A control mechanism operated by the weft selector means drives the weft guide mechanism into and out of a condition providing the aforesaid position of the weft yarn.

7 Claims, 10 Drawing Figures

WEFT-YARN DRAWING-OFF AND LENGTH-MEASURING APPARATUS OF WEAVING LOOM HAVING WEFT SELECTOR MEANS

BACKGROUND OF THE INVENTION

The present invention relates to weaving looms and, more particularly, to a weft-yarn drawing-off and length-measuring apparatus for use in a weaving loom of the type in which the weft yarns of different natures, typically of different colors.

The weft-yarn drawing-off and length-measuring apparatus of this character use a combination of a length-measuring roller rotatable about a fixed axis and a pressing roller which is in rolling contact with the length-measuring roller and which is rotatable about an axis parallel and movable with the axis of rotation of the length-measuring roller. The length-measuring roller is driven at a constant speed in synchronism with other driven units of the loom so that a weft yarn passed between the length-measuring and pressing rollers, in rolling contact with each other, is drawn off successively in predetermined length from a yarn package.

Such a weft-yarn drawing-off and length-measuring apparatus is used in combination with program-controlled weft control means adapted to deliver a mechanical weft-change signal for causing the drawing-off and length-measuring apparatus to move the weft yarn between a position or direction passable between the length-measuring and pressing rollers and a position or direction deviated from the position passable between the rollers.

The measured length of weft yarn is picked in a suitable manner into the shed of warp yarns and forms a fell at the edge of a woven fabric during each cycle of operation of the loom, as is well known in the art. The length in which the weft yarn is drawn off through the length-measuring and pressing rollers in each cycle of operation of the loom determines the width of the woven fabric and is dictated by the diameter of the length-measuring roller which is in use. The length-measuring roller is thus arranged to be exchangeable with another length-measuring roller having a different diameter so as to permit selection of the width of a fabric to be woven.

When the length-measuring roller is exchanged with another roller having a larger or smaller diameter, the pressing roller carried on the new length-measuring roller is curvilinearly moved in an arc upwardly or downwardly from the original position thereof. This results in a change in the position or direction of the weft yarn relative to the line of contact between the rollers and it frequently happens that the weft yarn is moved out of the position or direction passable between the rollers. To remedy such a condition, laborious and meticulous efforts are required for the re-adjustment of the guide means retaining the weft yarn.

SUMMARY OF THE INVENTION

An important object of the present invention is to provide an improved weft-yarn drawing-off and length-measuring apparatus which is free from the above-mentioned drawbacks.

Another important object of the invention is to provide an improved weft-yarn drawing-off and length-measuring apparatus featuring weft guide means having simple and small-sized construction.

In accordance with the present invention, there is provided a weft-yarn drawing-off and length-measuring apparatus of a weaving loom including program-controlled weft selector means adapted to deliver a weft-change signal in accordance with a predetermined schedule, comprising a detachable length-measuring roller rotatable about a fixed axis. The length-measuring roller is exchangeable with another length-measuring roller having a different diameter. A pressing roller rotatable about an axis parallel with the fixed axis of rotation of the length-measuring roller and movable relative to the fixed axis. A roller support mechanism including a parallelogrammic four-bar linkage constrains the pressing roller to move substantially prependicularly to the axis of rotation of the length-measuring roller, and biasing means for urging the four-bar linkage in a direction to hold the pressing roller in contact with the length-measuring roller. The length-measuring roller and the pressing roller are operable to pass therebetween a weft yarn when held in rolling contact with each other. A weft guide mechanism is provided and is movable with the axis of rotation of the pressing roller and has a first condition holding the weft yarn in an operative position perpendicularly aligned with the line of contact between the length-measuring roller and the pressing roller and a second condition holding the weft yarn out of the operative position. A control mechanism is operatively connected to the weft selector means and includes an elongated member pivotally connected to the weft guide mechanism and movable in response to the weft-change signal from the weft selector means for driving the weft guide mechanism into the first condition in the presence of the signal and into the second condition in the absence of the signal. The above-mentioned weft guide mechanism preferably comprises first lever means rotatable about an axis substantially normal to the plane containing the respective axes of rotation of the length-measuring and pressing rollers, a yarn guide element fixedly mounted on the first lever means for retaining the weft yarn. The first lever means is rotatable between a first angular position holding the yarn guide element in a position in which the weft yarn is held in the operative position and a second angular position holding the yarn guide element in a position holding the weft yarn out of the operative position. Second lever means is provided rotatable about an axis parallel and movable with the axis of rotation of the pressing roller and adjustably connected to the first lever means. The elongated member of the control mechanism is pivotally connected to the second lever means for moving, through the second lever means, the first lever means between the first and second conditions thereof in response to the weft-change signal from the weft selector means. The weft guide mechanism may further comprise an adjustable connecting member pivotally connected to the first lever means and having a threaded longitudinal portion axially movably engaged by the second lever means and internally threaded fastening elements fitted to the threaded longitudinal portion of the connecting member for adjustably fastening the connecting member to the second lever means. On the other hand, the previously mentioned roller support mechanism may further include a roller support member having one end portion carrying the pressing roller. In this instance, the parallelogrammic four-bar linkage forming part of the roller support mechanism consists of a pair of spaced parellel crank arms each rotatable about a fixed axis parallel with the axis of rotation of the length-measuring roller and a link bar pivotally connected to the crank arms and integral with or forming part of the above-mentioned roller support member. The control mechanism may further include an intermittent-motion cam operatively connected to the previously mentioned weft selector means, lever means carrying a cam follower engageable with the cam, and biasing means urging the lever means to have the cam follower in rolling contact with the cam, wherein the previously mentioned elongated member is pivotally connected to the lever means so that the first lever means is urged toward the first angular position thereof.

BRIEF DESCRIPTION OF THE DRAWINGS

The features and advantages of the weft-yarn drawing-off and length-measuring apparatus according to the present invention will be more clearly appreciated from the following description taken in conjunction with the accompanying drawings in which like reference numerals designate the same members, structures and axes of rotation of rotary members and structures and in which.

DESCRIPTION OF THE PREFERRED EMBODIMENTS

Figure 1:
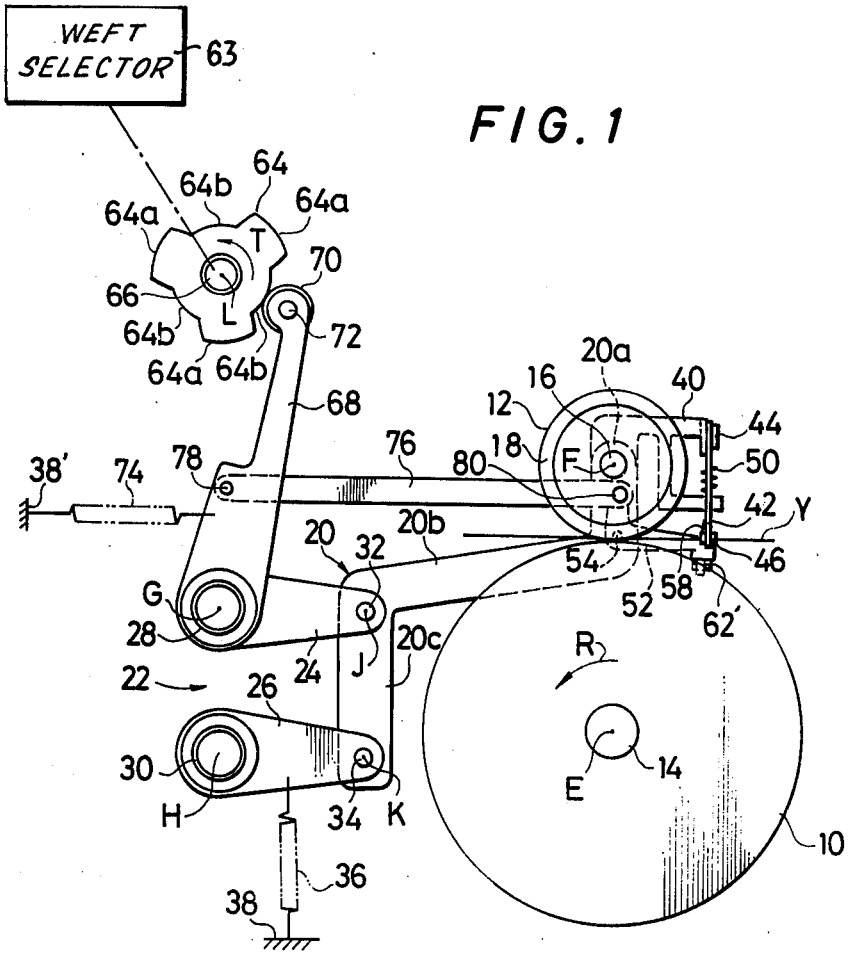
FIG. 1 is a side elevation view of a preferred embodiment of the apparatus according to the present invention, the apparatus being viewed from one side thereof.

The construction, operation and advantages of the weft-yarn drawing-off and length-measuring apparatus embodying the present invention will be hereinafter described in detail with reference to the accompanying drawings. For the sake of clarity, the majority of conventional parts and structures of the weaving loom incorporating the shown apparatus has been omitted from the drawings. The relative positioning of the apparatus of the present invention will however be quite apparent from the direction in which a weft yarn Y for being processed by the apparatus extends.

Construction

Referring concurrently to FIGS. 1 to 4, the weft-yarn drawing-off and length-measiring apparatus embodying the present invention comprises a length-measuring roller 10 and a pressing roller 12 which is preferably smaller in diameter than the length-measuring roller 10 as shown. The length-measuring roller 10 is rotatable with a horizontal shaft 14 having a fixed rotational axis E, while the pressing roller 12 is positioned above the length-measuring roller 10 and is rotatable on a horizontal shaft 16 having a rotational axis F which is substantially parallel with the rotational axis E of the length-measuring roller 10 and which is movable, especially in vertical direction, relative to the rotational axis E. The rotational axis E of the length-measuring roller 10 and the rotational axis F of the pressing roller 12 are on a common substantially vertical plane which is slightly rotatable about the rotational axis E of the length-measuring 10 as the pressing roller 12 is moved relative to the roller 10, as will be discussed in more detail. The shaft 14 supporting the length-measuring roller 10 is connected to a suitable driving unit (not shown) adapted to drive the roller 10 for rotation in the direction of an arrow R about the above-mentioned axis E in synchronism with other driven members of the loom. The pressing roller 12 is held in rolling contact as at C with the length-measuring roller 10 as will be described later and is thus driven for rotation in the direction of an arrow S about the above-mentioned axis F with a circumferential speed equal to the circumferential speed of rotation of the length-measuring roller 10 when the roller 10 is driven by the driving unit. The length-measuring roller 10 is detachable from the shaft 14 and is interchangeable with another length-measuring roller (shown at 10' in FIGS. 7 and 8) having a larger or smaller diameter. The pressing roller 12 is shown to have one of its end faces chamfered along the entire circumference edge thereof.

Figures 2, 3:
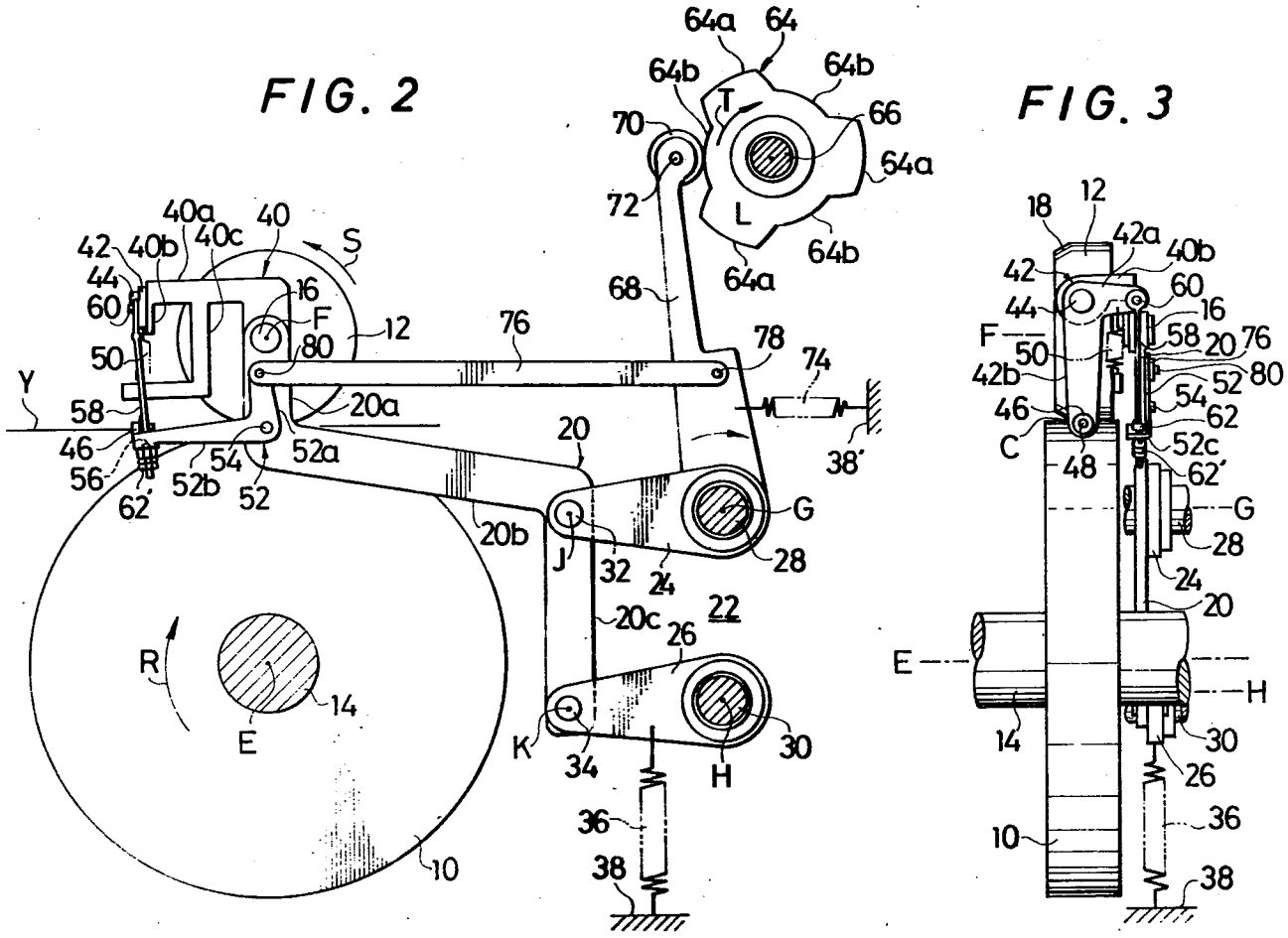
FIG. 2 is a view similar to FIG. 1 but shows the apparatus viewed from the other side thereof.
FIG. 3 is a front view of the apparatus illustrated in FIGS.1 and 2, the apparatus of FIGS. 1 to 3 being in a condition in which the weft yarn is ready to be drawn off and measured for length.

The weft-yarn drawing-off and length-measuring apparatus of the present invention further comprises a roller support mechanism for supporting the pressing roller 12 in position relative to the length-measuring roller 10. The roller support mechanism comprises a movable roller support member 20 and a parallelogrammic four-bar linkage 22. The roller support member 20 consists of an upwardly extending upper end portion **20*a* supporting the shaft 16 of the pressing roller 12, a generally horizontal intermediate portion 20*b* extending from the lower end of the upper end portion 20*a*, and a lower end portion 20*c* extending downwardly from the leading end of the intermediate portion 20*b*, as illustrated in FIGS. 1 and 2. On the other hand, the parallelogrammic four-bar linkage 22 comprises upper and lower crank arms 24 and 26 having substantially equal lengths and a link bar constituted by the above-mentioned lower end portion 20*c* of the roller support member 20. The upper and lower crank arms 24 and 26 are pivotally connected, each at one end, to upper and lower stationary shafts 28 and 30, respectively, which are fixedly mounted on a suitable stationary structure (not shown) forming part of the loom construction and which have horizontal center axes G and H, respectively, which are in a common vertical plane substantially parallel with the previously mentioned common vertical plane containing the rotational axes E and F of the length-measuring and pressing rollers 10 and 12, respectively. The crank arms 24 and 26 are rotatable about the center axes G and H of the shafts 28 and 30, respectively, in a common vertical plane which is normal to the common vertical plane containing the axes G and H. The upper and lower crank arms 24 and 26 are, furthermore, pivotally connected at the other ends thereof to the above-mentioned link bar, viz., the lower end portion 20***c* of the roller support member 20 by pivotal shafts 32 and 34 having horizontal center axes J and K, respectively. The link bar 20*c* and each of the crank arms 24 and 26 are thus rotated relative to each other about each of the center axes J and K of the pivotal shafts 32 and 34 when the roller support member 20 is moved relative to the stationary shafts 28 and 30, viz., when the pressing roller 12 carried by the roller support member 20 is moved relative to the fixed axis E of the shaft 14 supporting the length-measuring roller 10. The length between the respective center axes G and J of the stationary shaft 28 and pivotal pin 32 interconnected by the upper crank arm 24 is substantially equal to the length between the respective center axes H and K of the stationary shaft 30 and pivotal pin 34 interconnected by the lower crank arm 26 and the length between the respective center axes J and K of the pivotal pins 32 and 34 is substantially equal to the length between the respective center axes G and H of the stationary shafts 28 and 30. Thus, the parallelogrammic four-bar linkage 22 is constructed by the upper and lower crank arms 24 and 26, the lower end portion 20*c* of the roller support member 20 and the stationary structure (not shown) fixedly supporting the stationary shafts 28 and 30. The shafts 28 and 30 constitute the stationary pair-members and the pivotal pins 32 and 34 constitute moving pair-members in the four-bar linkage 22. The four-bar linkage 22 thus arranged is urged to move the roller support member 20 in a direction to force the pressing roller 12 into pressing engagement with the length-measuring roller 10 by a suitable biasing means such as a helical tension spring 36 which is shown anchored at one end to the lower crank arm 26 and at the other end to a suitable stationary structure 38 forming part of the loom construction and which is thus operative to constantly bias the lower crank arm 26 and accordingly the upper crank arm 24 to rotate clockwise in FIG. 1 or counterclockwise in FIG. 2 about the center axes G and H of the stationary shafts 28 and 30, respectively. If desired, such a spring may be connected not to the lower crank arm 26 but to the lower crank arm 24 or any portion of the roller support member 20 though not shown.

The weft-yarn drawing-off and length-measuring apparatus embodying the present invention further comprises a weft guide mechanism which is adapted to move the weft yarn Y into and out of the position, or direction, perpendicularly aligned with the extent of the contact line C between the length-measuring and pressing rollers 10 and 12, viz., into and out of the position passable between the rollers 10 and 12. The position of the weft yarn Y extending perpendicularly in alignment with the extent of the contact line C between the rollers 10 and 12 and thus passable therebetween is herein referred to as the "operative" position of the weft yarn. In contrast thereto, the position of the weft yarn Y deviated from the operative position is herein referred to as the "inoperative" position of the weft yarn.

Figure 4:
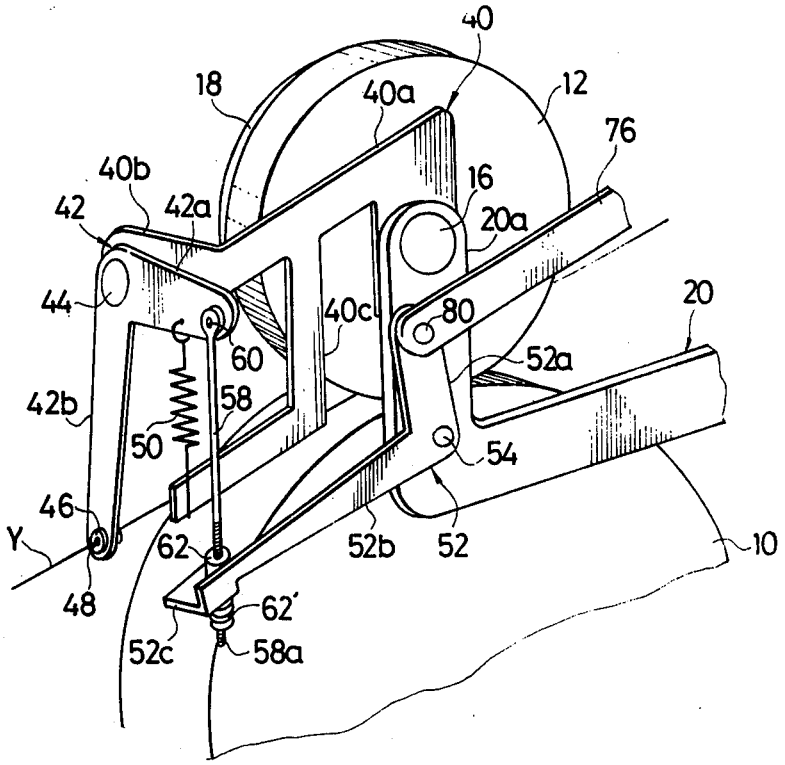
FIG. 4 is a fragmentary perspective view principally showing, to an enlarged scale, the weft guide mechanism forming part of the embodiment illustrated in FIGS. 1 to 3.
Figures 5, 6:
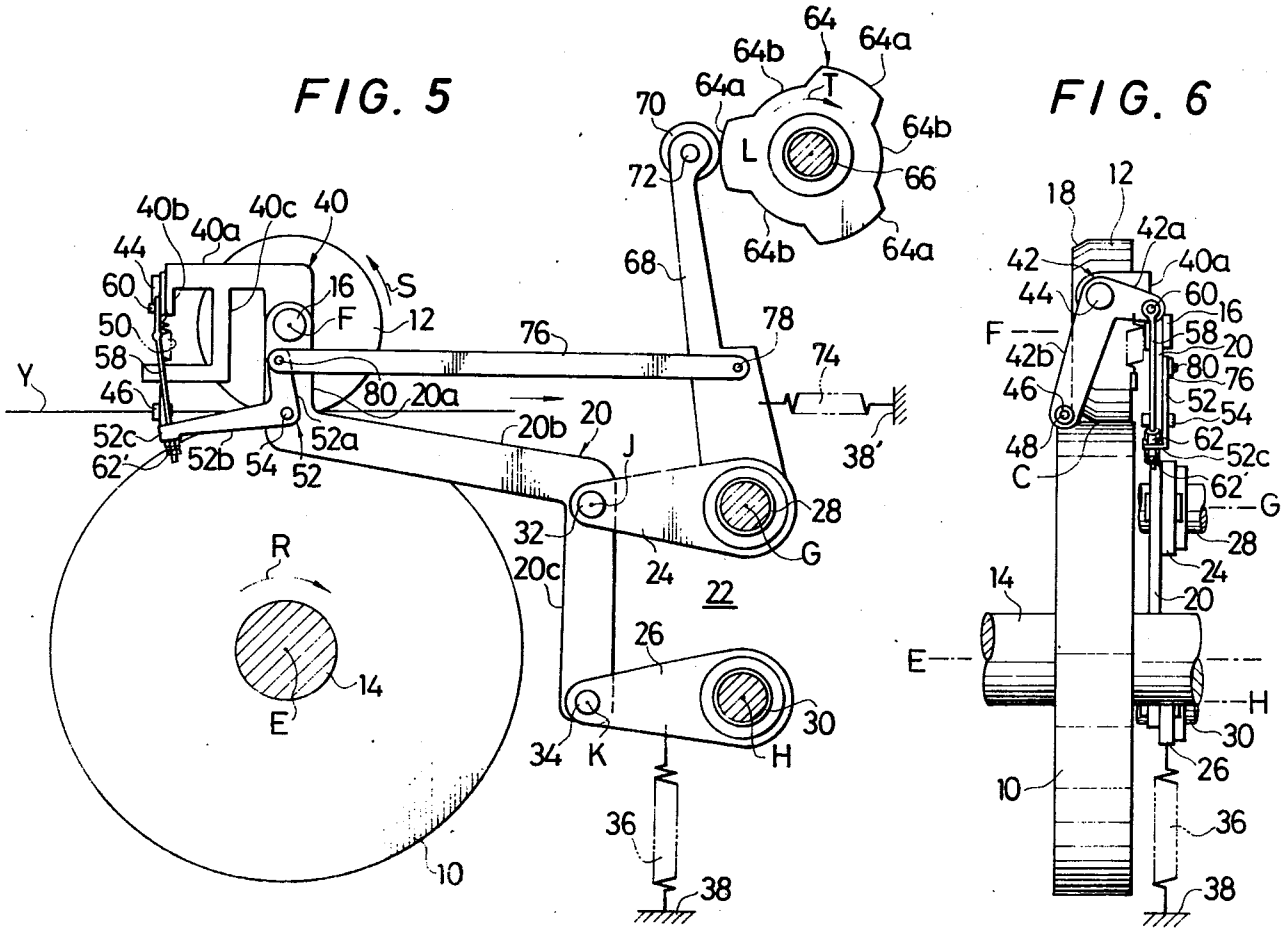
FIG. 5 is a side elevation view similar to FIG. 2 but shows the apparatus in a condition in which the weft yarn is moved into a position inoperable for being drawn off and measured for length.
FIG. 6 is a front view similar to FIG. 3 but shows the apparatus in the same condition as in FIG. 5.

As will be best seen in FIG. 4, the weft guide mechanism comprises a lever support member 40 which consists of a generally horizontal longitudinal portion 40*a* fixedly connected to the upper end portion 20*a* of the previously described roller support member 20 and extending substantially in parallel with the path of the weft yarn Y in the above-mentioned operative position, a lateral end portion 40*b* perpendicularly bent from the leading end of the longitudinal portion 40*a*, and a generally L-shaped arm position 40*c* extending downwardly from the longitudinal portion 40*a* and then in parallel with the longitudinal portion 40*a* and terminating approximately below the leading end of the longitudinal portion 40*a*. The lateral end portion 40*b* is located over the path of the weft yarn Y in the above-mentioned operative position and is radially spaced apart from the peripheral surface of the pressing roller 12. The lever support member 40 is rotatable with the roller support member 20 about the center axis F of the shaft 16 carrying the pressing roller 12 and is thus urged downwardly by means of the tension spring 36 connected to the previously described four-bar linkage 22. A generally 7-shaped guide lever 42 has an intermediate fulcrum portion pivotally connected to the lateral side end portion 40*b* by a pivotal pin 44. The pin 44 has a center axis substantially perpendicular to the center axis F of the pressing roller 12 so that the guide lever 42 is rotatable about the center axis of the pin 44 in a vertical plane substantially parallel with the rotational axis F of the pressing roller 12. The guide lever 42 has an upper arm portion 42*a* extending approximately horizontally from the intermediate fulcrum portion of the lever and slidable on the lateral end portion 40*b* of the lever support member 40 and a lower arm portion 42*b* extending generally downwardly from the fulcrum portion and perpendicularly spaced apart from the upper arm portion 40*a*. The upper arm portion 40*a* of the lever 42 is formed with or securely connected to a downward projection 40*c* at its free end for the reason that will be understood as the description proceeds. The guide lever 42 has at the free end of the lower arm portion 42*b* thereof a yarn guide element 46 formed with a hole 48 through which the weft yarn Y is to be movably passed. The guide lever 42 is rotatable about the center axis of the above-mentioned pin 44 between a first angular position in which the hole 48 in the guide element 46 is located in alignment with the path of the weft yarn Y in the operative position as will be best seen in FIG. 3 and a second angular position in which the hole 48 in the guide element 48 is sidewise deviated from such a path of the weft yarn Y (FIG. 6). The guide lever 42 is urged to turn for the second angular position by suitable biasing means such as a helical tension spring 50 which is anchored at one end to the upper arm portion 42*a* of the lever 42 and at the other end to the leading end of the arm portion 40*c* of the previously described lever support member 40. When the guide lever 42 is in the first angular position thereof against the force of the tension spring 50, the upper arm portion 42*a* of the lever extends substantially in parallel with the lateral end portion 42*b* of the lever support member 40 as seen in FIGS. 3 and 4.

The weft guide mechanism further comprises an actuating lever 52 having an intermediate fulcrum portion pivotally connected to the upper end portion 20*a* of the previously described roller support member 20 by a pivotal pin 54. The pivotal pin 54 has a center axis which is parallel with and located below the center axis F of the shaft 16 carrying the pressing roller 12 so that the actuating lever 52 is rotatable about the center axis of the pin 54 in a vertical plane perpendicular to the rotational axis F of the pressing roller 12. The actuating lever 52 has an upper arm portion 52*a* extending generally upwardly from the intermediate fulcrum portion of the lever and slidable on the outer face of the upper end portion 20*a* of the roller support member 20, and a lower arm portion 52*b* extending approximately horizontally from the fulcrum portion and perpendicularly spaced apart from the upper arm portion 52*a*. The actuating lever 52 further has a bent end portion 52*c* which is laterally bent from the leading end of the lower arm portion 52*b* of the lever and which is located below the downward projection 42*c* of the upper arm portion 42*a* of the guide lever 42. The bent end portion 52*c* is formed with a hole 56 (indicated by broken lines in FIG. 2) which is substantially in line with the upper arm portion 42*a* of the guide lever 42. An adjustable connecting rod 58 has a threaded lower end portion 58*a* and is pivotally connected at the upper end to the downward projection 42*c* of the guide lever 42 by a pivotal pin 60. The threaded lower end portion 58*a* of the connecting rod 58 is axially passed through the hole 56 in the bent end portion 52*c* of the actuating lever 52 and is fastened to the bent end portion 52*c* by means of a pair of internally threaded elements or nuts 62 and 62' which are fitted to the threaded lower end portion 58*a* and which are in clamping engagement with the bent end portion 52*c* from the upper and lower faces, respectively, of the portion 52*c*. The pivotal pin 60 has a center axis substantially parallel with the center axis of the pivotal pin 44 interconnecting the guide lever 42 and the lever support member 40 so that the guide lever 42 is caused to turn about the axis of the pivotal pin 44 when the connecting rod 58 is axially moved upwardly or downwardly by the actuating lever 52 rotated about the center axis of the pivotal pin 54 on the roller support member 20. The relative positions of the guide and actuating levers 42 and 52 to each other and accordingly the distance between the upper arm portion 42*a* of the guide lever 42 and the lower arm portion 52*b* of the actuating lever 52 can be varied by moving the nuts 62 and 62' on the threaded end portion 58*a* of the connecting rod 58 with the bent end portion 52*c* of the actuating lever 52 interposed between the nuts 62 and 62'.

The actuating lever 52 is rotated about the center axis of the pivotal pin 54 by means of a control mechanism which is operated under the control of suitable program-controlled weft selector means 63 such as a pattern-card arrangement (not shown). As illustrated in FIGS. 1 and 2, the control mechanism comprises an intermittent-motion cam 64 rotatable with a shaft 66 having a horizontal center axis L which is substantially parallel with the rotational axes E and F of the length-measuring and pressing rollers 10 and 12 and the center axes of the stationary shafts 28 and 30 of the four-bar linkage 22. The intermittent-motion cam 64 is shown to be formed with three cam lobe portions 64*a* which have a common radius of curvature and equal central angles about the center axis L of the shafts 66 and which are equiangularly spaced apart from each other across low arc portions 64*b* having a common radius of curvature which is smaller than the radius of curvature of the cam lobe portions 64*a*. The shaft 66 is operatively connected to the above-mentioned program-controlled weft selector means 63 so that the cam 64 is driven for rotation about the axis L through angles and at timings which are preliminarily programmed on such means. Since the construction and arrangement of the weft selector means of this nature is well known in the art of the textile industry and is rather immaterial for the understanding of the present invention, description thereof will not be herein incorporated.

The control mechanism further comprises a rocker 68 which is mounted at one end on the stationary shaft 28 of the four-bar linkage 22 and which is thus rotatable about the center axis G of the shaft 28 independently of the crank arm 24 which is also mounted on the shaft 28. The rocker 68 has at its free end a roller 70 which is rotatable on a shaft 72 having a center axis parallel with the rotational axis G of the shaft 28 and accordingly with the rotational axis L of the cam 64. The roller 70 is held in rolling contact with the cam 64 by suitable biasing means such as a helical tension spring 74 which is anchored at one end to a suitable stationary structure 38' forming part of the loom construction and at the other end to the rocker 68 for urging the rocker to turn about the center axis G of the shaft 28 in a counterclockwise direction in FIG. 1 or in a clockwise direction in FIG. 2. As the cam 64 is rotated about the center axis L of the shaft 66 in the direction of arrow T, the center axis of the shaft 72 carrying the cam follower roller 70 is moved in an arc and accordingly the rocker 68 is turned about the center axis G of the stationary shaft 28. The roller 70 is held in rolling contact with the cam 64 by the action of the tension spring 74, the rocker 68 is alternately turned about the center axis G of the stationary shaft 28 between a first angular position having the roller 70 received on one of the low arc portions 64*b* of the cam 64 and a second angular position having the roller 70 received on one of the cam lobe portions 64*a* of the cam 64. The rocker 68 is, thus, oscillated between these first and second angular positions as the cam 64 is driven to turn about the axis L of the shaft 66. In the description to follow, it is assumed that the cam 64 is held in an angular position having one of its cam lobe portions 64*a* contacted by the roller 70 in the presence of a weft change signal from the previously mentioned program-controlled weft selector means and in an angular position having one of its low arc portions 64*b* contacted by the roller 70 in the absence of such a signal from the weft selector means.

A horizontal control rod 76 is pivotally connected at one end to the rocker 68 by a pivotal pin 78 and at the other end to the upper arm portion 52*a* of the previously mentioned actuating lever 52 by a pivotal pin 80. The tension spring 74 is, thus, not only operative to urge the rocker to turn in a direction to have the roller 70 held in rolling contact with the cam 64 but, through the control rod 76, bias the actuating lever 52 to turn about the center axis of the pivotal pin 54 counterclockwise in FIG. 1 to clockwise in FIG. 2, viz., in a direction to bias, through the connecting rod 58, the guide lever 42 to turn about the center axis of the pivotal pin 44 toward the previously mentioned first angular position thereof against the force of the tension spring 50 connected to the lever 42. If desired, the rocker 68 may be mounted on a shaft which is arranged separately of the stationary shaft 28 forming part of the four-bar linkage 22, though not shown in the drawings. The cam 64 has been described as having three cam lobe portions but such a configuration of the cam 64 is merely for the purpose of illustration and may therefore be varied or modified is numerous manners if desired.

Operation

Description will be hereinafter made with reference to FIGS. 5 and 6 as well as to FIGS. 1 to 4 in respect of the operation of the weft-yarn drawing-off and length-measuring apparatus having the construction hereinbefore described.

Throughout operation of the loom, the length-measuring roller 10 is kept driven to rotate at a constant velocity in the direction of the arrow R about the axis E of the shaft 14 so that the pressing roller 12 held in rolling contact with the former at the line C is driven to rotate in the direction of the arrow S about the axis F of the shaft 16 with a circumferential velocity equal to that of the length-measuring roller 10, as previously noted. If, under these conditions, the cam 64 of the control mechanism is in an angular position having one of its low arc portions **64*b* contacted by the roller 70 on the rocker 68 in the absence of a weft-change signal from the weft control means connected to the cam 64, the rocker 68 is held in the previously mentioned first angular position thereof as illustrated in FIGS. 1 and 2. As a consequence, the control rod 76 interconnecting the rocker 68 and the actuating lever 52 of the yarn guide mechanism is held in the leftmost longitudinal position in FIG. 1 (or the rightmost longitudinal position in FIG. 2) and maintains the actuating lever 52 in an angular position turned clockwise in FIG. 1 (or counterclockwise in FIGS. 2 and 4) about the pivotal pin 54. The connecting rod 58 interconnecting the actuating lever 52 and the guide lever 42 is accordingly held in the uppermost position relative to the lever support member 40 and holds the guide lever 42 in the previously mentioned first angular position thereof against the force of the tension spring 50 which is stretched between the upper arm portion 42*a* of the guide lever 42 and the arm portion 40*c* of the lever support member 40. The lower arm portion 42*b* of the guide lever 42 is thus held in the position having the yarn guide element 46 located perpendicularly in alignment with the contact line C between the length-measuring roller 10 and the pressing roller 12, as will be best seen in FIG. 3. The weft yarn Y passed through the hole 48 in the guide element 46 is therefore held in the previously mentioned operative position thereof and is interposed between the length-measuring and pressing rollers 10 and 12 and is drawn off successively in predetermined length which is determined by the diameter of the length-measuring roller 10**.

In the presence of the weft-change signal delivered from the weft selector means, the cam 64 is in an angular position having one of its cam lobe portions **64*a* contacted by the cam follower roller 70 on the rocker 68, which is accordingly held in the previously mentioned second angular position thereof as illustrated in FIG. 5 against the force of the tension spring 74. Under these conditions, the control rod 76 between the rocker 68 and the actuating lever 52 is held in the leftmost longitudinal position in FIG. 5 and maintains the actuating lever 52 is an angular position turned clockwise in FIG. 5 about the pivotal pin 54. The connecting rod 58 between the actuating lever 52 and the guide lever 42 is accordingly held in the lowermost position relative to the lever support member 40 and holds the guide lever 42 in the previously mentioned second angular position thereof in cooperation with the tension spring 50. The lower arm portion 42*b* of the guide lever 42 is thus held in the position having the yarn guide element 46 located out of alignment with the contact line C between the length-measuring roller 10 and the pressing roller 12 as will be best seen in FIG. 6. The weft yarn Y passed through the hole 48 in the guide element 46 is therefore held in the previously mentioned inoperative position and is thus dislocated from between the rollers 10 and 12 and is detained in the position until the weft-change signal acting on the cam 64** is cancelled.

Advantages

Principal advantages of the above described embodiment of the present invention will be hereinafter described with reference to FIGS. 7 and 8, when necessary, back to any of FIGS. 1 to 6 as well.

Figure 8:
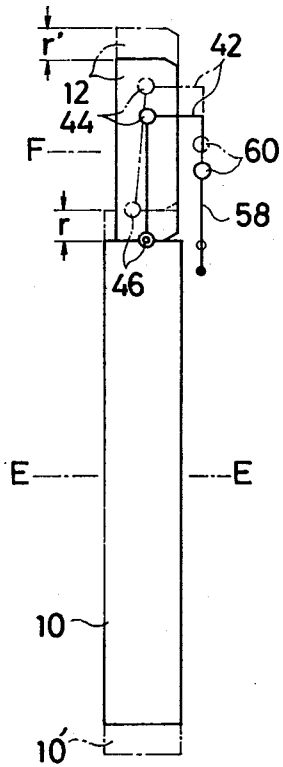
FIG. 8 is a diagrammatic front view of the apparatus embodying the present invention.
Figure 7:
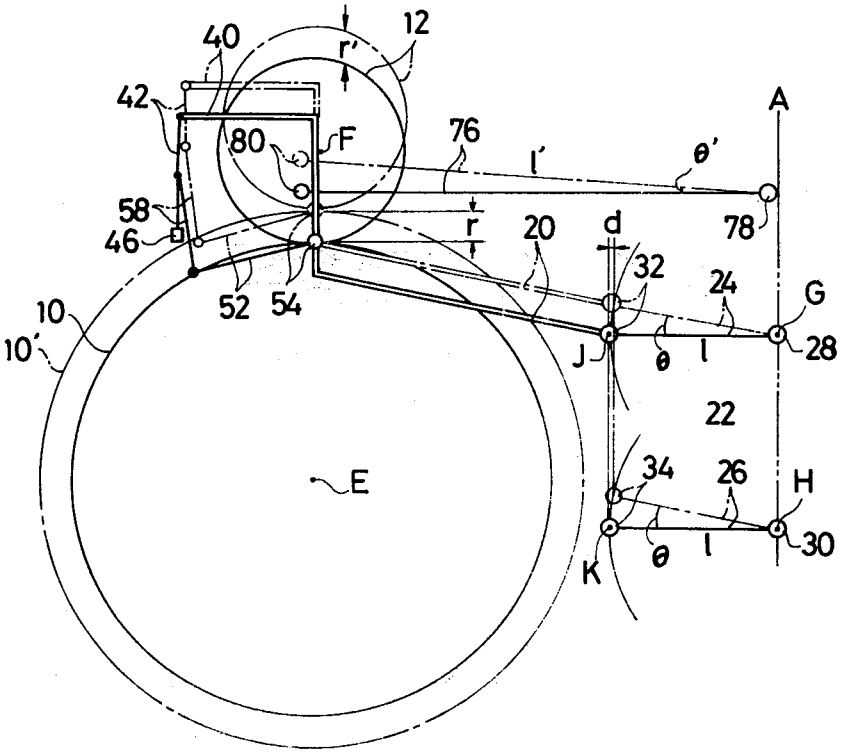
FIG. 7 is a diagrammatic side elevation view of the apparatus embodying the present invention.

In FIGS. 7 and 8, the members and structures of the above described embodiment are diagrammatically indicated by full lines which are designated by the same reference numerals as those used in FIGS. 1 to 6 and, similarly, the axes of rotation of some of the rotary elements included in the embodiment are indicated by points designated by the same characters as those used in FIGS. 1 to 6. The members and structures indicated by the full lines in FIGS. 7 and 8 are, furthermore, assumed to be in the positions holding the weft yarn (not shown in FIGS. 7 and 8) in the previously mentioned operative position passable between the length-measuring and pressing rollers 10 and 12 as in FIGS. 1 to 4. When the members and structures are held in such positions, the upper and lower crank arms 24 and 26 of the four-bar linkage 22 and the control rod 76 of the control mechanism extend substantially horizontally in parallel with each other. Because, in this instance, the lower end portion **20*c* of the roller support member 20 extends vertically and the respective center axes G and H of the stationary shafts 28 and 30 are located in a vertical plane, the parallelogrammic four-bar linkage 22 in its entirety assumes a rectangular configuration as will be seen in FIG. 7**.

When the length-measuring roller 10 is exchanged with another length-measuring roller 10' having a larger diameter under these conditions, the individual members and structures shown in FIGS. 7 and 8 are moved into the positions indicated by dot-and-dash line. If, in this instance, the radius of the new length-measuring roller 10' is larger by $r$ than the original roller 10, then the pressing roller 12 in contact with the length-measuring roller 10' is moved upwardly a distance $r'$ which is substantially equal to the difference $r$ between the diameters of the rollers 10 and 10'. As a consequence, the roller support member 20 and accordingly the pivotal pins 32 and 34 of the four-bar linkage 22 are moved upwardly through the distance $r'$ so that the crank arms 24 and 26 of the linkage 22 are rotated clockwise in FIG. 7 through equal angles $\theta$ about the axes G and H of the upper and lower stationary shafts 28 and 30, respectively, because the length between the axes J and K of the pivotal pins 32 and 34 is equal to the length between the axes G and H of the stationary shafts 28 and 30 and the length between the axes G and J of the shaft 28 and pin 32 is equal to the length between the axes 30 and 34 of the shaft 30 and pin 34. The upper and lower crank arms 24 and 26 moved into the positions indicated by the dot-and-dash lines are maintained in parallel with each other with the center axes J and K of the pivotal pins 32 and 34 moved in arcs indicated by curves $a_1$ and $a_2$, respectively, having equal radii of curvature. The initially rectangular four-bar linkage 22 is thus deformed into a rhomboid configuration with each of the center axes J and K of the pivotal pins 32 and 34 moved a small distance $d$ toward the vertical plane (indicated by line A in FIG. 7) containing the center axes G and H of the stationary shafts 28 and 30.

The axis of rotation of the pressing roller 12 and accordingly the line of contact between the pressing roller 12 and the new length-measuring roller 10' are thus made closer by the distance *d* to the vertical plane A than the rotational axis F of the initially positioned roller 12 and the line of contact between the pressing roller 12 and the initial lengthmeasuring roller 10.

While the roller support member 20 and accordingly the pivotal pin 80 at one end of the control rod 76 are moved upwardly as a result of the upward displacement of the pressing roller 12, the pivotal pin 78 at the other end of the control rod 76 is maintained in situ with the cam 64 assumed to be held at rest so that the initially horizontal control rod 76 is caused to slightly turn clockwise in FIG. 7 about the center axis of the pivotal pin 76 through a certain angle which is denoted by $\theta'$. The pivotal pin 80 interconnecting the control rod 76 and the actuating lever 52 is therefore slightly moved toward the above-mentioned vertical plane A. Since, however, the angle $\theta'$ of rotation of the control rod 76 is smaller than the angle $\theta$ of rotation of each of the crank arms 24 and 26 of the four-bar linkage 22 because the control rod 76 is longer than each of the crank arms, the distance of displacement of the pivotal pin 80 toward the vertical plane A is smaller than the above-mentioned distance *d* of the pressing roller 12, the pivotal pin 80 is moved leftwardly in FIG. 7 relative to the pressing roller 12 through a small distance which is equal to the difference between the distance *d* of displacement of the pressing roller 12 and the distance of actual displacement of the pin 80 relative to the vertical plane A. (Here, it may be noted that the above-mentioned angle $\theta'$ of rotation of the control rod 76 about the center axis of the pin 76 is given by $\theta \times l/l'$, where *l* is the length between the axis G or H of the stationary shaft 28 or 30 and the axis J or K of the pivotal pin 32 or 34 and l' is the length between the respective center axes of the pins 76 and 80 at the ends of the control rod 76.)

With the pivotal pin 80 thus moved leftwardly in FIG. 7 relative to the pressing roller 12 in the raised position indicated by the dot-and-dash line, the actuating lever 52 is caused to turn counterclockwise about the center axis of the pivotal pin 54 from its original angular position relative to the roller support member 20 and accordingly to the lever support member 40. Because, in this instance, the distance of displacement of the pivotal pin 80 relative to the pressing roller 12 is sufficiently small as will be understood from the above discussion, the angle of rotation of the actuating lever 52 which is rotated about the center axis of the pivotal pin 54 is negligible for all practical purposes and, for this reason, the actuating lever 52 can be deemed to be held in the initial angular position relative to the roller support member 20 and accordingly to the lever support member 40. This means that the angle of rotation (counterclockwise in FIG. 8) of the guide lever 42 about the center axis of the pivotal pin 44 as caused by the slight rotation of the actuating lever 52 relative to the roller and lever support members 20 and 40 is practically negligible and, thus, the guide lever 42 can also be regarded to be held in the original angular position relative to the lever support member 20, as will be seen from FIG. 8. The yarn guide element 46 is therefore maintained in the position perpendicularly aligned with the line of contact between the length-measuring roller 10' and the pressing roller 12. The slight displacement of the yarn guide element 46 as seen in FIG. 8 can be remedied by moving the nuts 62 and 62' toward the lower end of the threaded end portion 58*a* of the adjustable connecting rod 58 until the yarn guide element 46 thus rotated counterclockwise in FIG. 8 about the center axis of the pivotal pin 44 restores its original angular position relative to the lever support member 40.

From the foregoing discussion it will be understood that the position of the yarn guide element 46 relative to the pressing roller 12 is maintained substantially unchanged when the pressing roller 12 is moved from its original position as a result of a change in the diameter of the length-measuring roller and that, even when the yarn guide element 46 may be slightly moved away from its original position relative to the pressing roller 12, the position of the guide element can be readily re-adjusted. Such advantages result, inter alia, from the use of the parallelogrammic four-bar linkage 22 by which the rotational motions of the crank arms 24 and 26 are converted into vertical movement of the pressing roller 12, as will be appreciated from comparison with the arrangement of FIGS. 9 and 10 in which a single crank bar 22' is used in lieu of the four-bar linkage 22.

Figure 10:
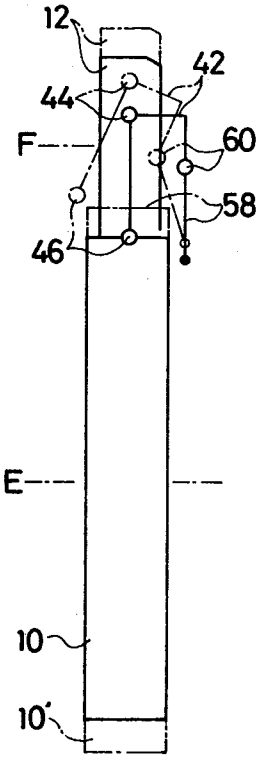
FIG. 10 is a diagrammatic front view of the arrangement illustrated in FIG. 9, the arrangement of FIGS. 9 and 10 being presented for the purpose of clarifying major advantages of the apparatus embodying the present invention.
Figure 9:
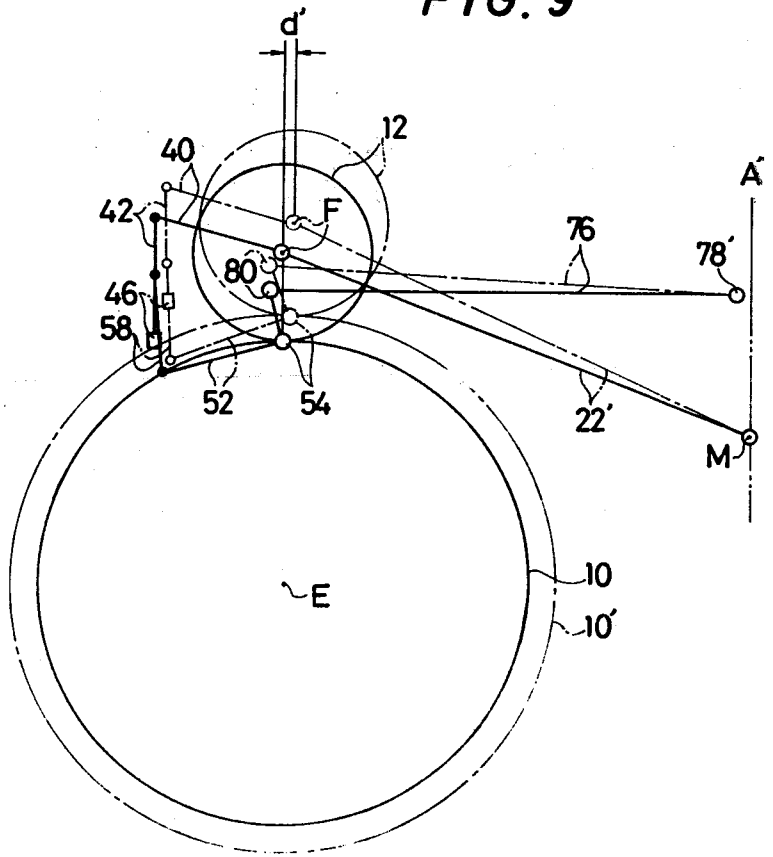
FIG. 9 is a diagrammatic side elevation view essentially similar to FIG. 7 but shows an arrangement in which a single crank bar is used in lieu of the four-bar linkage incorporated into the embodiment of the present invention.

Referring to FIGS. 9 and 10, the crank bar 22' is rotatable about a fixed horizontal axis M parallel with the rotational axis F of the pressing roller 12 and is pivotally connected to the shaft 16 (FIGS. 1 to 6) of the pressing roller 12. When, thus, the length-measuring roller 10 is replaced with the length-measuring roller 10' having a larger diameter and accordingly the pressing roller 12 is moved upwardly from its original position indicated by the full line, the crank bar 22' is caused to turn clockwise in FIG. 9 about the fixed axis M as indicated the dot-and-dash line so that the center axis F of the pressing roller 12 is moved in an arc into the position indicated by the dot-and-dash line in FIG. 9. The pressing roller 12 is consequently moved a distance *d'* toward a vertical plane A' containing the axis M and parallel with the center axis F of the pressing roller 12. While these occur, the control rod 76 is rotated clockwise in FIG. 9 so that the pivotal pin 80 connecting the control rod 76 to the actuating lever 52 is moved toward the vertical plane A'. For the reason previously explained with reference to FIGS. 7 and 8, however, the pivotal pin 80 is moved leftwardly in FIG. 9 relative to the pressing roller 12 and causes the actuating lever 52 to turn counterclockwise in FIG. 9 about the pivotal pin 54. This, in turn, causes the guide lever 42 to rotate counterclockwise in FIG. 10 so that the yarn guide element 46 is moved out of the position perpendicularly aligned with the line of contact between the length-measuring roller 10' and the pressing roller 12, as indicated by the dot-and-dash lines in FIG. 10. Elaborate and laborious efforts will be required for the re-adjustment of the weft guide mechanism.

What is claimed is:

1. - A weft-yarn drawing-off and length-measuring apparatus of a weaving loom including program-controlled weft selector means adapted to deliver a weft-change signal in accordance with a predetermined schedule, comprising:

a detachable length-measuring roller rotatable about a fixed axis, means for rotatably mounting said length-measuring roller and for mounting it removable and exchangeable with another length-measuring roller having a different diameter;

a pressing roller rotatable about an axis parallel with the fixed axis of rotation of the length-measuring roller and movable relative to the fixed axis;

a roller support mechanism including a parallelogrammic four-bar linkage for constraining said pressing roller to move substantially perpendicularly to the axis of rotation of the length-measuring roller, and biasing means for urging said four-bar linkage in a direction to hold said pressing roller in contact with the length-measuring roller, the length-measuring roller and the pressing roller being operable to pass therebetween a weft yarn when held in rolling contact with each other;

a weft guide mechanism movable with the axis of rotation of said pressing roller and having a first condition of operation for holding the weft yarn in an operative position generally perpendicularly aligned with the line of contact between the length-measuring roller and the pressing roller and a second condition of operation for holding the weft yarn out of said operative position; and a control mechanism operatively connected to said weft selector means and including an elongated member pivotally connected to said weft guide mechanism and movable in response to said weft-change signal from said weft selector means for driving the weft guide mechanism into said first condition in the presence of said signal and into said second condition in the absence of said signal.

2. - A weft-yarn drawing-off and length-measuring apparatus as set forth in claim 1, in which said weft guide mechanism comprises first lever means rotatable about an axis substantially normal to the plane containing the respective axes of rotation of said length-measuring and pressing rollers, a yarn guide element fixedly mounted on said first lever means for retaining the weft yarn, means for rotatably mounting the first lever means rotatable between a first angular position holding said yarn guide element in a position in which the weft yarn is held in said operative position and a second angular position holding the yarn guide element in a position holding the weft yarn out of said operative position, means comprising a second lever means rotatable about an axis parallel and movable with the axis of rotation of the pressing roller and adjustably connected to said first lever means, and means for pivotally connecting said elongated member of said control mechanism to said second lever means for moving, through said second lever means, said first lever means between said first and second conditions thereof in response to said weft-change signal from said weft selector means.

3. A weft-yarn drawing-off and length-measuring apparatus as set forth in claim 2, in which said weft guide mechanism further comprises an adjustable connecting member pivotally connected to said first lever means and having a threaded portion axially movably engaged by said second lever means and internally threaded fastening elements fitted to said threaded portion of said connecting member for adjustably fastening the connecting member to said second lever means.

4. A weft-yarn drawing-off and length-measuring apparatus as set forth in claim 3, in which said roller support mechanism further includes a roller support member having one end portion carrying said pressing roller, and in which a parallelogrammic four-bar linkage consists of a pair of spaced parallel crank arms each rotatable about a fixed axis parallel with the axis of rotation of the length-measuring roller and a link bar pivotally connected to said crank arms and integral with said roller support member.

5. - A weft-yarn drawing-off and length-measuring apparatus as set forth in claim 4, in which said weft guide mechanism further comprises a lever support member movable with said roller support member and carrying said first lever means, said first lever means having a first arm portion to which said adjustable connecting member is pivotally connected with a pivotal axis substantially parallel with the axis of rotation of the first lever means and a second arm portion angularly spaced part from said first arm portion about the axis of rotation of the first lever means and carrying said yarn guide element thereon, means for pivotally connecting said second lever means to said roller support member with a pivotal axis substantially in parallel with the axis of rotation of said pressing roller and having a first arm portion pivotally connected to said elongated member of said control mechanism with a pivotal axis substantially in parallel with the axis of rotation of the pressing roller and a second arm portion angularly spaced apart from the first arm portion of the second lever means about the axis of rotation of the second lever means and having a free end located in conjunction with the first arm portion of the first lever means, said adjustable connecting member having its threaded portion engaged by said second arm portion of the second lever means.

6. A weft-arm drawing-off and length-measuring apparatus as set forth in claim 5, in which said weft guide mechanism further comprises biasing means for urging said first lever means toward said second angular position thereof.

7. - A weft-yarn drawing-off and length-measuring apparatus as set forth in claim 5, in which said control mechanism further includes an intermittent-motion cam rotatable about a fixed axis parallel with said axis of rotaion of the pressing roller, means for operatively connecting said cam to said program-controlled weft selector means for being driven for rotation about its axis in response to the weft-change signal from the selector means, lever means for rotation about a fixed axis parallel with the axis of rotation of said cam and carrying a cam follower engageable with the cam, and biasing means for urging said lever means of the control mechanism into engagement with said cam, said elongated member being pivotally connected to said lever means of the control mechanism with a pivotal axis substantially in parallel with the axis of rotation of the cam and urged by the biasing means of the control mechanism in a direction to turn said second lever means in a direction holding, through said adjustable connecting member, said first lever means in said first angular position, said cam having a configuration effective to drive said lever means of the control mechanism into an angular position holding said elongated member in a longitudinal position holding, through said second lever means and said adjustable connecting means, and said first lever means in said second angular position thereof.

* * * * *